US008213646B2

(12) United States Patent
Matsumoto et al.

(10) Patent No.: US 8,213,646 B2
(45) Date of Patent: Jul. 3, 2012

(54) APPARATUS FOR STEREOPHONIC SOUND POSITIONING

(75) Inventors: Yuji Matsumoto, Chiryu (JP); Sei Iguchi, Okazaki (JP); Wataru Kobayashi, Tokyo (JP); Kazuhiko Furuya, Chiba (JP); Keita Yonai, Yokohama (JP)

(73) Assignee: DENSO CORPORATION, Kariya (JP)

( * ) Notice: Subject to any disclaimer, the term of this patent is extended or adjusted under 35 U.S.C. 154(b) by 381 days.

(21) Appl. No.: 12/457,670

(22) Filed: Jun. 18, 2009

(65) Prior Publication Data

US 2009/0316939 A1 Dec. 24, 2009

(30) Foreign Application Priority Data

Jun. 20, 2008 (JP) ..... 2008-162003

(51) Int. Cl.
*H04R 5/02* (2006.01)

(52) U.S. Cl. ..... 381/302; 381/310; 381/300; 340/435; 340/436; 340/437

(58) Field of Classification Search ..... 381/86, 381/310, 300, 302; 340/435, 436, 437, 551, 340/552, 565

See application file for complete search history.

(56) References Cited

U.S. PATENT DOCUMENTS

| | | | | |
|---|---|---|---|---|
| 4,866,776 | A * | 9/1989 | Kasai et al. | 381/302 |
| 5,979,586 | A * | 11/1999 | Farmer et al. | 180/274 |
| 6,466,913 | B1 * | 10/2002 | Yasuda et al. | 704/500 |
| 6,763,115 | B1 | 7/2004 | Kobayashi | |
| 6,842,524 | B1 | 1/2005 | Kobayashi | |
| 6,868,937 | B2 * | 3/2005 | Cass | 181/192 |
| 7,092,531 | B2 * | 8/2006 | Enya et al. | 381/86 |
| 7,274,288 | B2 * | 9/2007 | Nagata | 340/438 |
| 2003/0021433 | A1 * | 1/2003 | Lee | 381/302 |
| 2003/0141967 | A1 | 7/2003 | Aichi et al. | |
| 2004/0184628 | A1 * | 9/2004 | Nakamichi et al. | 381/302 |
| 2005/0169484 | A1 * | 8/2005 | Cascone et al. | 381/61 |
| 2005/0280519 | A1 | 12/2005 | Nagata | |
| 2008/0152152 | A1 * | 6/2008 | Kimura | 381/17 |

FOREIGN PATENT DOCUMENTS

| | | | |
|---|---|---|---|
| JP | 60158800 A | * | 8/1985 |
| JP | 2006005868 | * | 5/2006 |
| JP | A-2006-279864 | | 10/2006 |
| JP | 2007312081 A | * | 11/2007 |

* cited by examiner

*Primary Examiner* — Davetta W Goins
*Assistant Examiner* — Kuassi Ganmavo
(74) *Attorney, Agent, or Firm* — Posz Law Group, PLC

(57) ABSTRACT

A stereophonic apparatus uses three speakers respectively installed toward a front of a vehicle on both shoulders of a seat back of a driver's seat and toward a back of the vehicle on an exact center in front of a driver. This configuration provides more effectively exerted positioning effects for a virtual sound source realized by using the three speakers, especially for the effects in a frontward field of sound.

4 Claims, 9 Drawing Sheets

30 DEG PITCH IN 12 DIRECTIONS

N: # OF TAPS
b: FILTERING COEF

APPARATUS FOR STEREOPHONIC SOUND POSITIONING

CROSS REFERENCE TO RELATED APPLICATION

The present application is based on and claims the benefit of priority of Japanese Patent Application No. 2008-162003, filed on Jun. 20, 2008, the disclosure of which is incorporated herein by reference.

FIELD OF THE INVENTION

The present disclosure generally relates to a stereophonic apparatus for use in a vehicle.

BACKGROUND INFORMATION

Conventionally, stereophonic sound systems using a right and a left speakers or the like to virtually positioning a stereo sound for a listener are known and manufactured. For example, Japanese patent documents JP3657120 and JP3880236 (equivalent to U.S. Pat. Nos. 6,763,115 and 6,842,524) disclose such technique.

However, by conducting an experiment, the inventor of the present disclosure found that, in those techniques, sound positioning effects by using two speakers installed on the right and the left side of listener (a test subject, or testee) illustrated in FIGS. 10A and 10B are not sufficient in terms of positioning a virtual sound source, especially in a front field of the listener.

SUMMARY OF THE INVENTION

In view of the above and other problems, the present disclosure provides a stereophonic apparatus that provides improved positioning effects for a listener of a virtual sound source through a sound signal control, especially for a front field of the listener.

In an aspect of the present disclosure, the present disclosure uses information from sensors that detect inside and outside conditions of a vehicle to notify a driver/occupant of the vehicle an object condition of an object such as an approach of an obstacle or the like through a sound from three speakers in a stereophonic manner. More practically, the three speakers are installed on the right side and the left side of the driver equidistantly from the right and the left ears (main-speakers), and right center in front of the driver (a sub-speaker) in the present disclosure. By using three speakers, in other words, a virtual sound source simulating an existence of the object outside of the vehicle can be effectively and intuitively conveyed to the driver of the vehicle. That is, the position of the virtual sound source can be accurately controlled according to the information derived from the sensors.

In a technique of the present disclosure, a right and a left main-speakers are installed respectively equidistantly on a right side and a left side relative to a right ear and a left ear of the occupant, and a sub-speaker is installed on a right-front position of the occupant. Further, a control unit for outputting a control signal for generating virtual sound based on determination of the object condition to be presented for the driver/occupant according to the sensor information is used, and a positioning unit for positioning a sound image of the object in an actual direction by performing, for a right and a left audio signals respectively directed to the right and the left main-speakers, signal processing that utilizes Head-Related Transfer Function that reflects a position of the object based on the control signal from the control unit is used. Furthermore, an enhance unit for enhancing the sound image by performing, for the right and the left audio signals respectively directed to the right and the left main-speakers, signal processing according to the position of the object is used, and a delay unit for correcting a difference of sound arrival times to the right and the left ears due to a difference of speaker-to-ear distances between the right and left main-speakers and the sub-speakers relative to the right and the left ears based on the control signal from the control unit according to the actual direction of the object is used. Yet further, a filter unit for processing the audio signal directed to the sub-speaker based on the control signal from the control unit according to the actual direction of the object is used, and a volume adjustment unit for adjusting sound volume of the right and the left main-speakers and the sub-speaker independently based on the control signal from the control unit according to the actual direction and a distance of the object is used.

In summary, the main-speakers on the right and left of the driver is supplemented by the sub-speaker for more accurately positioning or "rendering" the virtual sound source, the sound positioning effects are improved for the listener in the vehicle as confirmed in test examples described later.

The right center in front of the driver in the above description indicates that the sub-speaker is positioned in a virtual plane that vertically divides the driver into the right and the left side along his/her spine. The sound positioning processing in the positioning unit can be found, for example, in the claims of the Japanese patent document JP3657120 (equivalent to U.S. Pat. No. 6,763,115). In the positioning processing, Head-Related Transfer Functon is used to simulate the sound signals for the right and left ears through electronic filtering.

Further, the enhance unit for enhancing the sound image can be found, for example, in the claims of Japanese patent document JP3880236 (equivalent to U.S. Pat. No. 6,842,524). In the enhancement processing, the signal phase is delayed without changing the frequency characteristics, according to the increase of the frequency, for enhancing the directivity-related characteristics of the sound image. That is, the direction of the virtual sound source is emphasized throughout a wide range of sound frequencies.

BRIEF DESCRIPTION OF THE DRAWINGS

Objects, features, and advantages of the present disclosure will become more apparent from the following detailed description made with reference to the accompanying drawings, in which.

DETAILED DESCRIPTION

A best form (an embodiment) of the present disclosure is described in the following.

(1. Entire Structure)

The system configuration of the stereophonic apparatus of the present embodiment adapted for automobile use is described.

Figure 1:
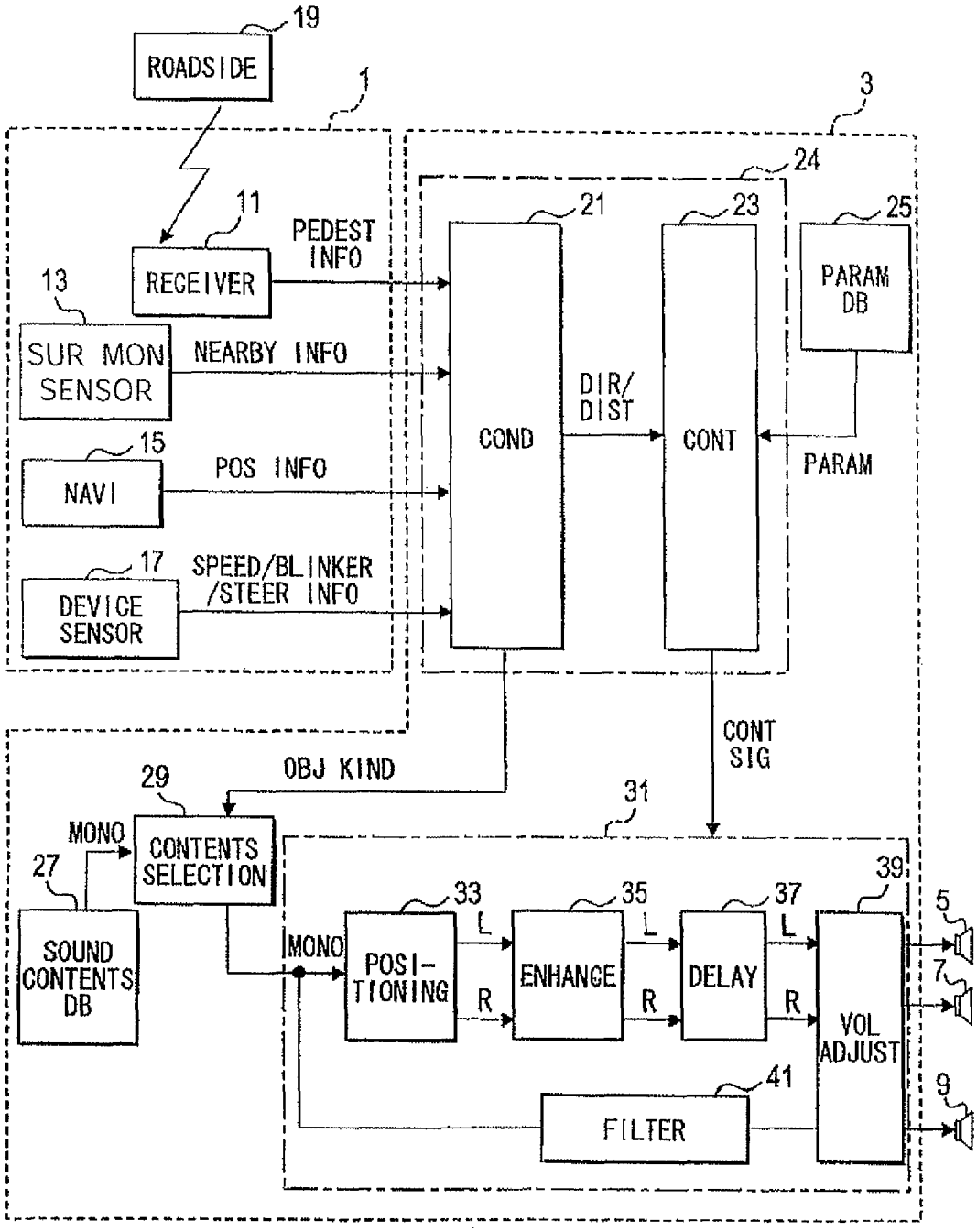
FIG. 1 is a block diagram showing a system configuration of a stereophonic apparatus in an embodiment of the present disclosure.

FIG. 1 is a block diagram which shows the system configuration of the vehicular stereophonic apparatus adapted for automobile use.

As shown in FIG. 1, the apparatus includes provides notification for an occupant of a vehicle by using a stereophonic virtual sound source, that is, the apparatus presets notification sound for a driver of the vehicle, for warning an unsafe object around the vehicle such as a motorcycle, a pedestrian or the like the vehicular stereophonic apparatus includes a sensor 1 for detecting information regarding the surroundings and the vehicle itself, a stereophonic controller 3 for processing stereophonic sound based on the information from the sensor 1, and three speakers 5, 7, 9 for generating the sound based on a signal from the controller 3.

Hereinafter, the structure of each of the above components is described.

(1) Sensor

The sensor 1 is, in the present embodiment, implemented as a receiver 11, a surround monitor sensor 13, a navigation equipment 15, and an in-vehicle device sensor 17.

The receiver 11 is used to wirelessly receive a captured image that is taken by a roadside device 19 at an intersection, for detecting a condition of the intersection, and to output the image to a vehicle condition determination unit 21. By analyzing the captured image, the vehicle condition determination unit 21 determines whether there is a pedestrian, a motorcycle or the like in the intersection.

The surround monitor sensor 13 is, for example, a camera which is used to watch the neighborhood/surroundings of the vehicle that is equipped with the stereophonic apparatus. The camera watches a front/rear/right and left sides of the vehicles. The captured image is transmitted from the camera to the vehicle condition determination unit 21 at a regular interval. Therefore, the pedestrian, the motorcycle or the like can be detected based on the analysis of the captured image.

The navigation apparatus 15 has a current position detection unit for detecting a current position of the vehicle as well as a traveling direction, and a map data input unit for inputting map data from map data storage medium such as a hard disk drive, DVD-ROM or the like. The current position detection unit is further used to detect data for autonomous navigation. Further, the navigation apparatus 15 performs a current position display processing to display, together with the current position of the subject vehicle, a map by reading the map data which contains the current position of the subject vehicle, a route calculation processing to calculate the best route from the current position to a destination, a route guide processing to navigate the vehicle to travel along the calculated route and so on.

The device sensor 17 is used to detect a vehicle condition and an occupant condition. That is, the sensor 17 detects a vehicle speed, a blinker condition, a steering angle and the like. The actual detection of those conditions can be performed, for example, by using a speed sensor, a blinker sensor, a steering angle sensor or the like.

(2) Speakers

Figure 2:
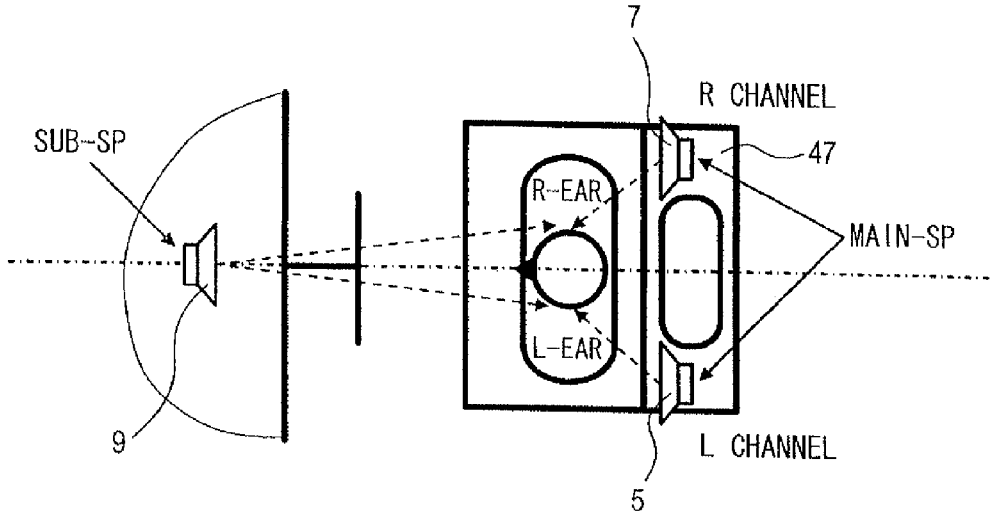
FIG. 2 is an illustration showing an arrangement of main-speakers and a sub-speaker.

The speakers 5 to 9 are installed around the driver. That is, for example, a left main-speaker 5 is arranged at a left shoulder of a seat back of a seat 47, and a right main-speaker 7 is at a right shoulder of the seat back, respectively facing frontward of the vehicle, as shown in FIG. 2.

Further, the sub-speaker 9 is arranged in front of the driver on a center plane (i.e., a virtual plane that divides the driver into the right side and the left side) facing the driver toward the rear of the vehicle.

By arranging the speakers in the above-described manner, a distance from the left main-speaker 5 to the left ear and a distance from the right-main-speaker 7 to the right ear become equal. That is, the right ear to the R channel distance and the left ear to the L channel distance become equal, thereby making it unnecessary to adjust timing of the audio signal that is output from the right and the left channels. Further, by arranging the sub-speaker 9 in the center-plane of the driver, the distance from the sub-speaker 9 to both of the right ear and to the left ear becomes equal, thereby achieving the same arrival timing of the audio signal to both ears.

Specifically, in the present embodiment, the three channel arrangement by using the right and left main-speakers 5, 7 and the sub-speaker 9, the notification sound has an improved positioning as shown in the description of the example experiment in the following.

Figure 3:
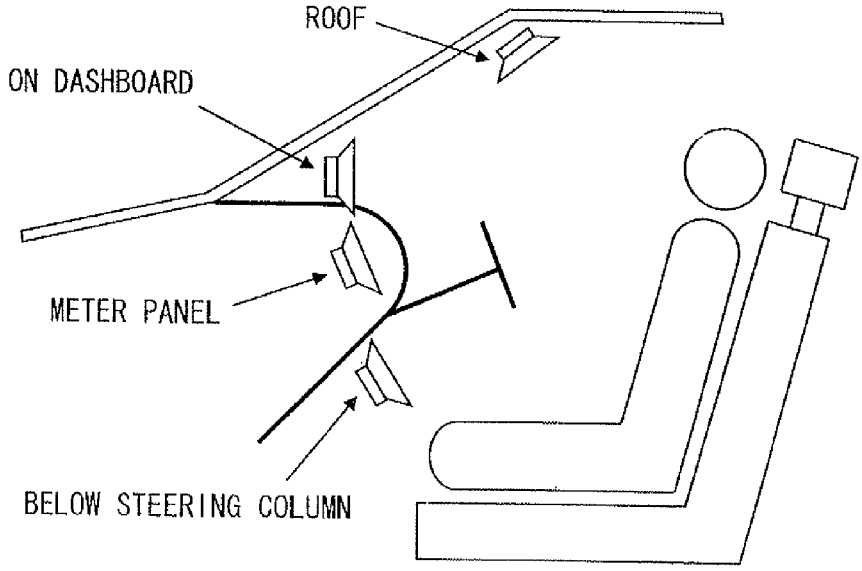
FIG. 3 is an illustration showing possible arrangement positions of the sub-speaker in a center plane of a driver.

The position of the sub-speaker 9 may be, for example, any position on the center plane of the driver. That is, the sub-speaker 9 may be installed under the roof, above the dashboard, on a meter panel, below a steering column or the like as shown in FIG. 3.

(3) Stereophonic Controller

The stereophonic controller 3 is a driver that drives the speakers 5 to 9 for setting a virtual sound source at an arbitrary distance/direction. That is, by providing the sound for the driver from the virtual sound source from that direction/distance, the stereophonic controller 3 intuitively enables the driver to pay his/her attention to that direction.

For example, the virtual sound source can be set to the arbitrary direction and the arbitrary distance by using the main-speakers 5, 7 and one piece of the sub-speaker 9, based on the adjustment of the sound pressure level and the delay of the acoustic information from those speakers 5 to 9.

Figure 4:
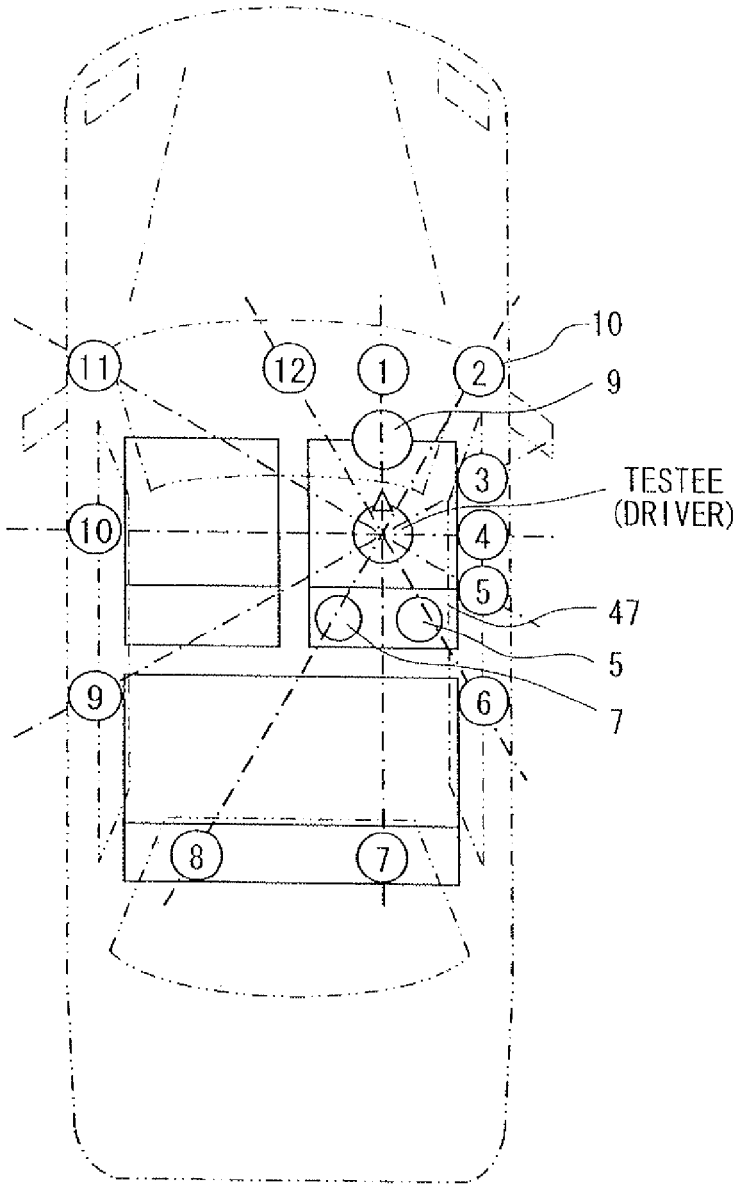
FIG. 4 is an illustration showing positioning directions of a virtual sound source.

For example, in the present embodiment, a virtual sound source is set in 12 directions at the 30 degree pitch relative to the driver as shown in FIG. 4. (In Japan, due to the left-side traffic system, the driver's seat in the vehicle is normally positioned on the right side of the vehicle. However, the nature of the present disclosure allows laterally-symmetrical replacement of system components such as the main/sub-speakers. That is, the right-left relations in the vehicle can be replaceable.)

The stereophonic controller 3 includes, as shown in FIG. 1, a control unit 24 having the vehicle condition determination unit 21 and a control processing unit 23, a control parameter database 25 (a control parameter storage unit), a contents database 27 (a sound contents storage unit), a sound contents selection unit 29, and a stereophonic generation unit 31. Further, the stereophonic generation unit 31 includes a sound image positioning unit 33 and a sound image enhance unit 35, a signal delay unit 37, a volume adjustment unit 39, and a filter unit 41.

The vehicle condition determination unit 21 outputs, to the control processing unit 23, the signal for generating the stereophonic sound according to the virtual sound source having a determined type/direction/distance of the object that is to be presented for the driver based on the sensor information derived from various sensors. Further, the determination unit 21 outputs object kind information indicative of the type of the object to the sound contents selection unit 29.

The control processing unit 23 generates, based on the signal from the vehicle condition determination unit 21, a control signal to generate stereophonic sound by acquiring control parameters from the control parameter database 25, and outputs the control signal to the stereophonic generation unit 31.

The control parameters regarding a presentation direction (indicative of an actual direction of the object) are, for example, time (phase) difference and sound volume difference of the right and left signals in the sound image positioning unit 33, as well as sound volume difference, time difference and frequency-phase characteristic of respective signals in the right and left signals in the sound image enhance unit 35, and delay time in the signal delay unit 37. The above control parameters further include the sound volume in the volume adjustment unit 39 and a tap number and filtering coefficients in the filter unit 41.

The sound contents selection unit 29 selects and acquires, based on the signal from the vehicle condition determination unit 21, the data according to the kind/type of the stereophonic sound to be generated from the sound contents database 27, and outputs the data to the sound image positioning unit 33 in the stereophonic generation unit 31. For example, when generating the stereophonic sound of a motorcycle, the selection unit 29 acquires sound data of a motorcycle from the database.

The sound image positioning unit 33 performs signal processing for the right and left audio signals (R and L signals) that positions the sound image in the direction of the object to be presented by simulating Head-Related Transfer Function according to the object direction with the utilization of the sound data input from the selection unit 29. The signal processing described above is disclosed, for example, in Japanese patent document No. 3657120.

As the basic factors of sound positioning for the listener, the time (phase) difference and the strength difference of the sound between both ears are emphasized. Those differences are caused by the reflection and diffraction of the sound in the head and the earlobe of the listener. That is, due to the difference in characteristics of the transmission paths from the sound source to the right and left ears (tympanums in the right and left ears), the sound positioning is determined. Therefore, in the present embodiment, the characteristics are represented in a high-fidelity manner by filters that simulate Head-Related Transfer Function, and the sound signals for positioning the virtual sound source in the right direction is generated by signal processing.

The sound image enhance unit 35 enhances the sound image by performing signal processing on the audio signals from the sound image positioning unit 33 according to the position of the sound source. The above processing is disclosed in, for example, in Japanese patent document No. 3880236.

The signal delay unit 37 correct the difference of the sound arrival times to the right and the left ears respectively from the main-speakers 5 and 7 relative to the sub-speaker 9 according to the direction of the object to be presented based on the right/left signals from the sound image enhance unit 35.

The volume adjustment unit 39 adjusts of the volume of the sound output from the main-speakers 5 and 7 and the sub-speaker 9 according to the direction and distance of the object to be presented based on the audio signals for the main-speakers 5 and 7 from the signal delay unit 37 and the audio signal for the sub-speaker 9 from the filter unit 41.

The filter unit 41 processes the audio signal for the sub-speaker 9 according to the direction of the object by using the data of the kind of the sound input from the sound contents selection unit 29.

Figure 5:
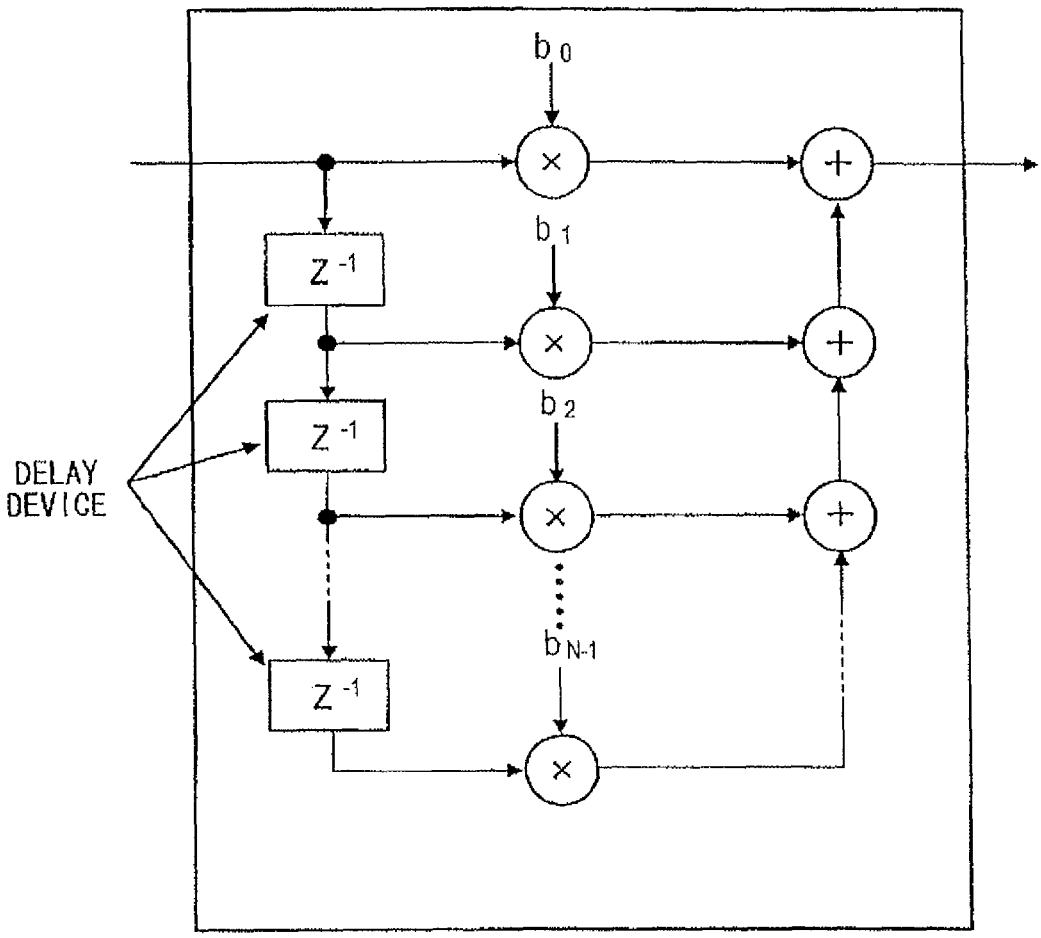
FIG. 5 is an illustration showing a structure of an FIR filter.
Figure 6A:
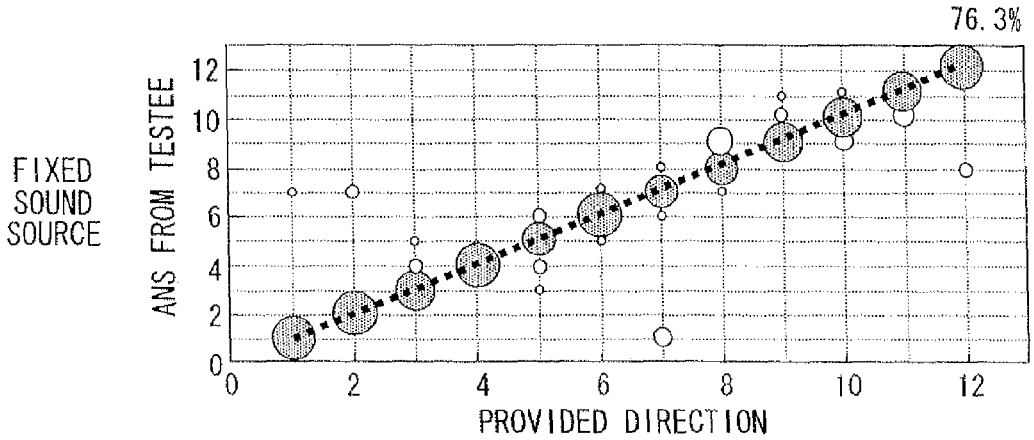
FIGS. 6A to 6C are diagrams showing results of an experiment about pink noise in a test example 2.
Figure 6B:
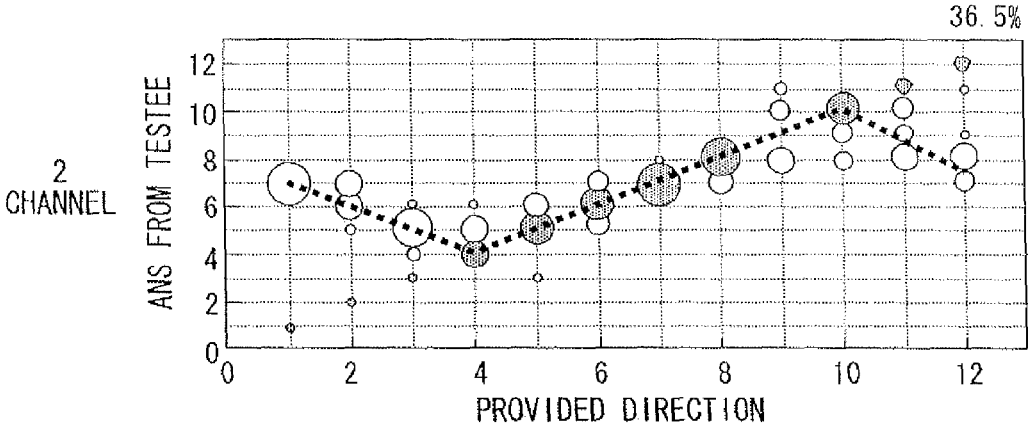
Figure 6C:
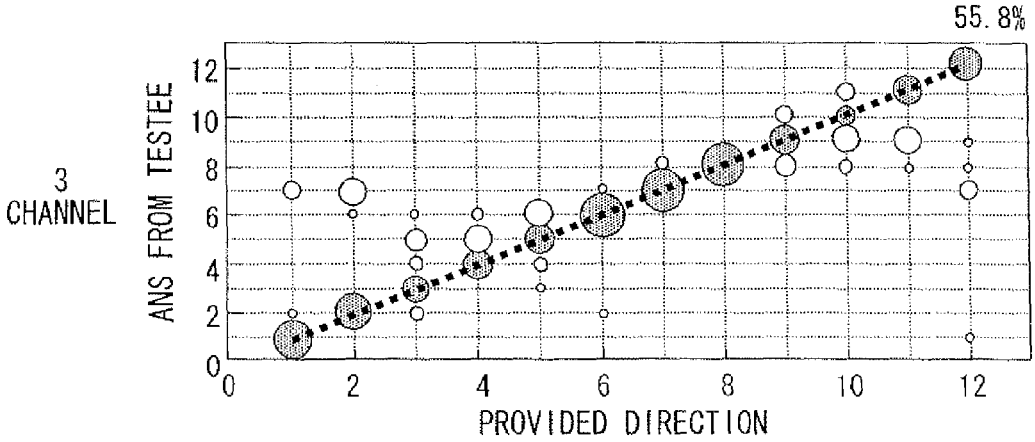
Figure 7A:
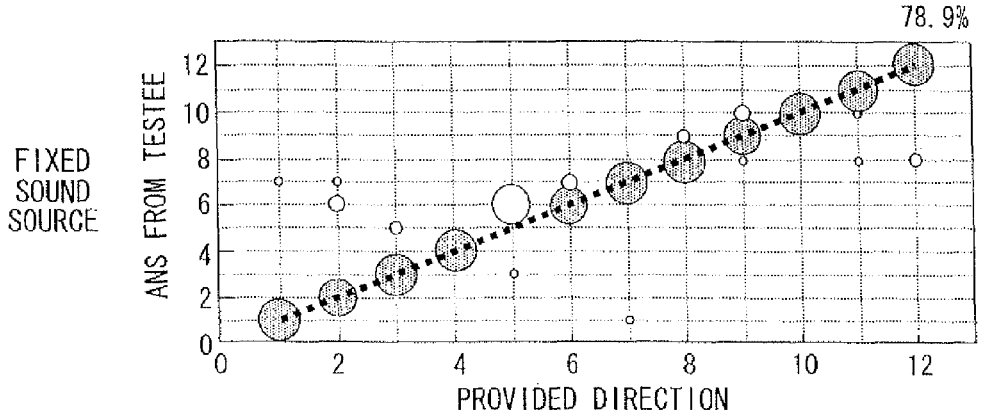
FIGS. 7A to 7C are diagrams showing results of another experiment about vocal sound in the test example 2.
Figure 7B:
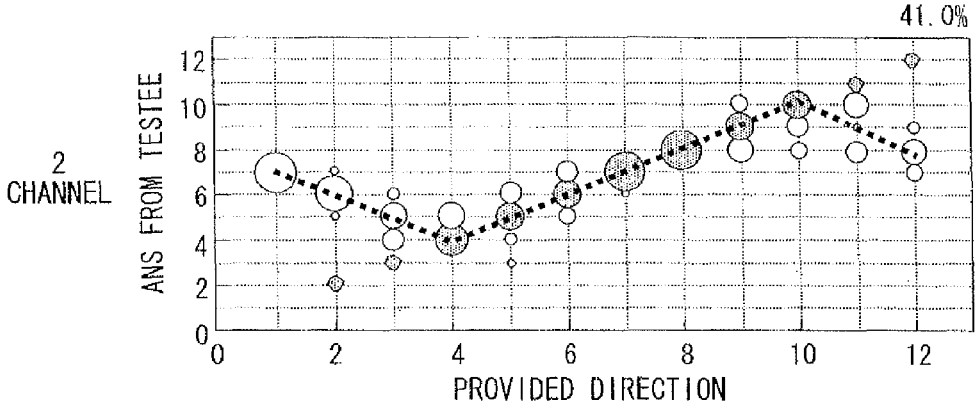
Figure 7C:
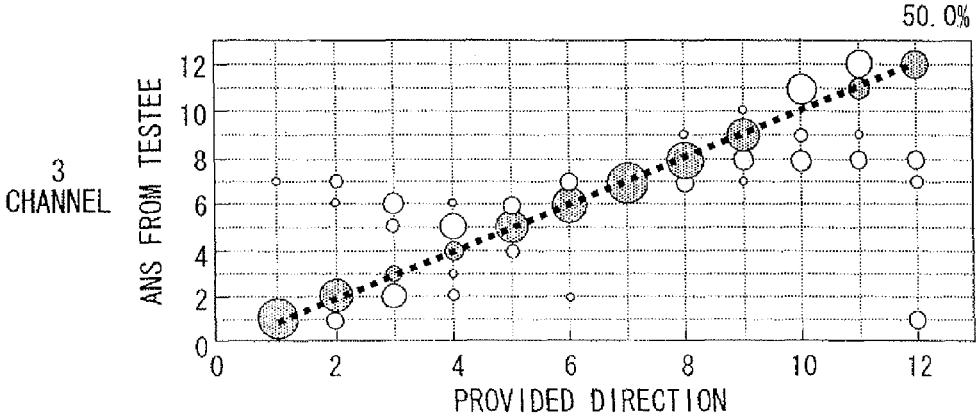

For example, as shown in FIG. 5, the filter unit 41 may be implemented as a FIR filter having a tap number of N and of a filtering coefficient of b.

The characteristics of the filter are defined as follows.

As mentioned above, the sub-speaker 9 is arranged in front of the driver of the center-plane. Therefore, the sound output from the sub-speaker 9 reaches both ears of the driver through the paths shown in FIG. 2. In the course of transmission to the ears, the effect of Head-Related Transfer Function is added to the sound.

On the other hand, the sound output from the main-speakers 5 and 7 has, by signal processing in the sound image positioning unit 33, the effect of Head-Related Transfer Function added thereto.

Therefore, at the time of reaching the driver's ear, the interference between the sound from the sub-speaker 9 and the sound from the main-speakers 5 and 7 may destroy the desired positioning effect.

According to the description in a paragraph [0020] in the above-referenced Japanese patent document No. 3657120, the sound having the high frequency above b kHz may effectively position the sound image when the sound volume for the right and the left ears is made respectively different. By utilizing this effect, the audio signal for the sub-speaker 9 is filtered to only pass through the signal of the lower frequency below b kHz (e.g., below 4 kHz), that is, by applying the low-pass filter, the interference above the b kHz is prevented for maintaining the volume difference between the sound from the main-speakers 5 and 7, thereby enabling the desired sound image positioning.

The number of the above-mentioned taps is defined in a table 1. That is, the number is set according to the direction of the object (according to the presentation direction of the object). That is, for example, for directions 1 to 4 and 10 to 12 representing vehicle side to vehicle front, the low tap numbers are set, as shown in FIG. 4. For directions 5 to 9 representing vehicle rear, the high tap numbers are set, so that the tap numbers for the vehicle rear directions are greater than the tap numbers for the vehicle front directions. In summary, the tap number n1 is smaller than the tap number n2.

TABLE 1

| Presentation direction | Tap number N |
|---|---|
| 1 | n1 |
| 2 | n1 |
| 3 | n1 |
| 4 | n1 |
| 5 | n2 |
| 6 | n2 |
| 7 | n2 |
| 8 | n2 |
| 9 | n1 |
| 10 | n1 |
| 11 | n1 |
| 12 | n1 |

Further, the filtering coefficient is set according to the respective presentation directions as shown in a table 2.

TABLE 2

| No. | Filtering coefficient: Directions 1 to 4, 10 to 12 | Filtering coefficient: Directions 5 to 9 |
|---|---|---|
| 0 | bF0 | bB0 |
| 1 | bF1 | bB1 |
| 2 | bF2 | bB2 |
| 3 | bF3 | bB3 |
| 4 | bF4 | bB4 |
| 5 | bF5 | bB5 |
| 6 | bF6 | bB6 |
| 7 | bF7 | bB7 |
| 8 | bF8 | bB8 |
| 9 | bF9 | bB9 |
| 10 | bF10 | bB10 |
| 11 | — | bB11 |
| 12 | — | bB12 |

Therefore, by employing the above-mentioned structure, it is possible that the virtual sound source is positioned at any arbitrary position by using the main-speakers 5 and 7 together with the sub-speaker 9 in three channels.

(2. Test Example)

Next, a test example is described as a confirmation of the effect of the present disclosure.

a) Test Example 1

In the test example 1, the main-speakers 5, 7 are installed on a right and a left shoulder portion of the sheet 47 (the driver's seat) as shown in FIG. 4.

By using the above configuration as shown in FIG. 3, the sub-speaker 9 is positioned under the roof, on the dashboard, on the meter panel, or below the steering column, and the sound image positioning as well as the sound wave cut-off and the front view are evaluated in the test example 1 based on the sensation reported by the test subjects.

More practically, improvement of the frontward sound image positioning is evaluated in comparison to the case where the sub-speaker 9 is not used. The evaluation is ranked as Excellent or Good, respectively representing great improvement and little improvement.

The sound wave cut-off is evaluated as a cut-off effect due to the steering wheel (a wheel portion or a center portion (a horn switch pad)). The evaluation is ranked as Excellent or Good, respectively representing high degree of cut-off and low degree of cut-off.

The front view evaluation is ranked as Excellent or Pass, respectively representing no view interference and no drivability interference.

TABLE 3

| Sub-speaker position | Front positioning effects | Sound wave cut-off | Front view interference |
|---|---|---|---|
| Meter Panel | Excellent | Good | Excellent |
| Dashboard | Excellent | Excellent | Pass |
| Steering Column | Good | Good | Excellent |
| Roof | Good | Excellent | Pass |

The test results in the above table show that, in all cases, the improvement due to the use of sub-speaker is confirmed.

b) Test Example 2

In the test example 2, the main-speakers 5, 7 are installed on a right and a left shoulder portion of the sheet 47 (the driver's seat) as shown in FIG. 4, and the sub-speaker 9 is installed in front of the driver on the center plane as described above. The sub-speaker 9 is, in this case, installed on the meter panel.

Further, as the fixed sound source that outputs a "real sound" instead of the virtual sound from the virtual sound source, 12 speakers 10 are arranged on the driver's horizontal plane in every 30 degrees (30 degrees pitch).

Then, 13 test subjects are examined in terms of from which direction the test subjects listen to the pink noise when each of the 12 speakers is used to randomly outputting the noise.

In addition, 2 channel system with only the right and the left main-speakers 5, 7 is used to position virtual sound source in directions 1 to 12. Again, the pink noise is randomly showered on the test subjects, and how they listen to the noise (from which direction) is examined.

Yet another configuration is set up as 3 channel system with the main-speakers 5, 7 and the sub-speaker 9. The test subjects are then examined for the pink noise positioning direction.

The positioning effect for voice is also examined by using testing sound.

The test results are summarized in a table 4. The table 4 shows the percentage of correct answers, that is, the matching rate of the test subject's answer with the presented sound source direction.

TABLE 4

| Sound Type | Fixed Sound Source | 2 Channel Virtual Sound Source | 3 Channel Virtual Sound Source |
|---|---|---|---|
| Pink Noise | 76.3% | 36.5% | 55.8% |
| Voice | 78.9% | 41.0% | 50.0% |
| # Of Testees | | 13 | |

As clearly shown in the table 4, the 3 channel system having the sub-speaker 9 is generally yield better results in comparison to the 2 channel system for both of the pink noise case and the voice case. That is, the higher positioning effects in the 3 channel system are confirmed.

Further, the same results are shown in the diagrams of FIGS. 6A to 6C and 7A to 7C. In those diagrams, the size of the circle represents the percentage of the correct answers from the test subjects.

As shown in the diagrams, the frontward positioning effects in the directions 1 to 3, 11 and 12 have poor results, indicating that the 2 channel system is not good at providing the virtual sound source positioning effects in frontward directions, which are improved by the use of the 3 channel system devised in the present disclosure.

(3. Explanation of Processing)

The processing of the stereophonic apparatus in the present embodiment is described in the following.

The vehicular stereophonic apparatus of the present embodiment is used for warning the driver of the vehicle, in a form of sound information, that there is an object that should be taken care of in the proximity of the vehicle.

Figure 8:
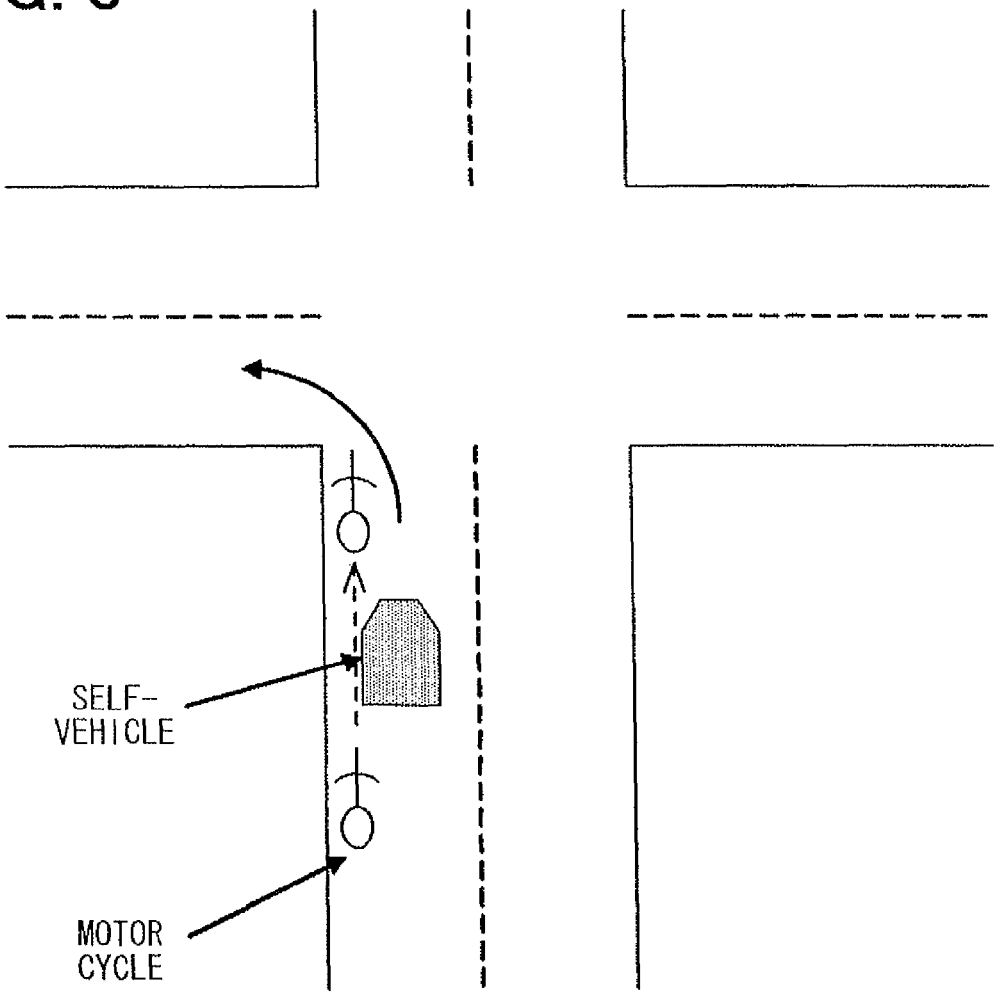
FIG. 8 is an illustration of a situation in which a motorcycle is approaching on the left from behind of a vehicle.

More practically, when the vehicle is about to turn left at an intersection as shown in FIG. 8, sound information regarding a motorcycle that is on the left behind the vehicle is provided from the virtual sound source for the driver. In this situation, the motorcycle is typically attempting to go through the narrow path between the vehicle and the side walk, and the driver can hardly watch that dead angle, due to the C pillar of the vehicle and/or the dead angle of the side mirror, for example.

(In Japan, due to the left-side traffic system, vehicles travel on the left side of the road. However, the nature of the present disclosure allows laterally-symmetrical replacement of traffic situations. That is, the right-left relations of the traffic can be replaceable.)

Figure 9:
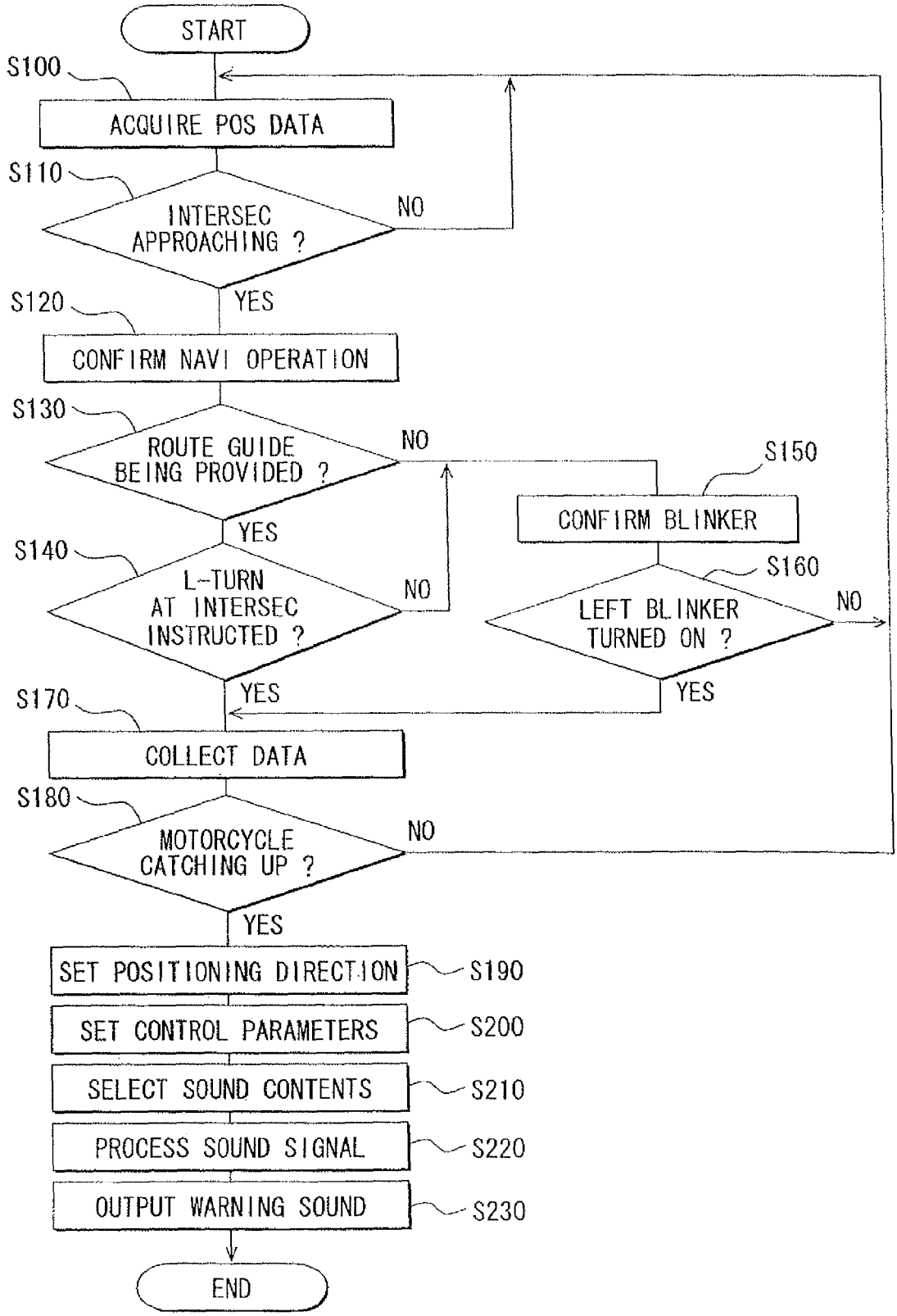
FIG. 9 is a flow chart showing processing to output a warning sound in the embodiment.
Figure 10A:
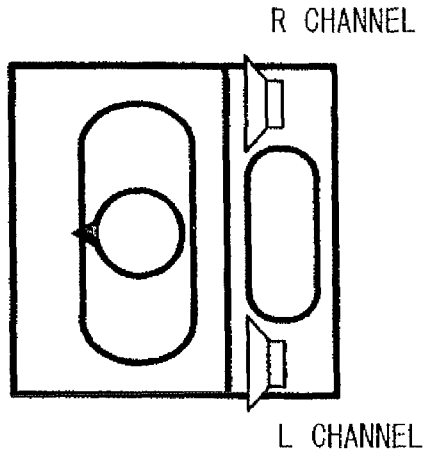
FIG. 10A PRIOR ART
FIGS. 10A and 10B are illustrations showing a conventional technique.
Figure 10B:
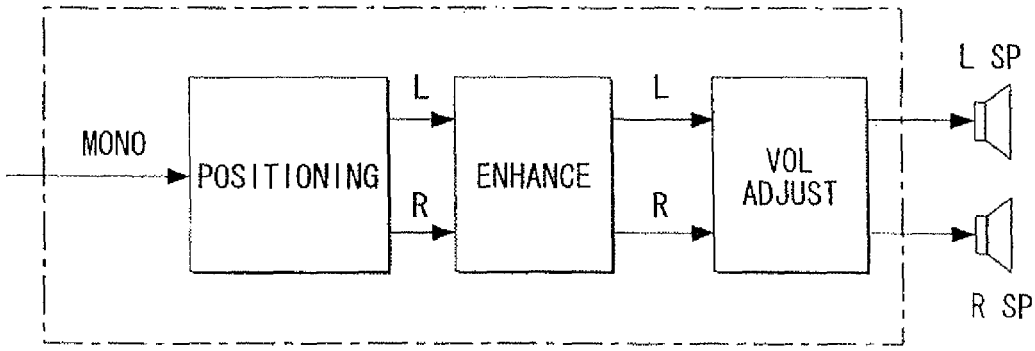
FIG. 10B PRIOR ART

The motorcycle warning-process at the time of left-turning by the stereophonic controller 3 is performed according to the flow chart in FIG. 9.

The stereophonic controller 3 starts a motorcycle warning-process when the vehicle is turning left, and the controller 3 acquires, as data, a self-vehicle's current position in S100 from the navigation apparatus 15.

Then, in S110, the process determines whether or not the self-vehicle is in a condition of approaching an intersection based on the information (the current position and the map data) from the navigation apparatus 15.

If the vehicle is determined as not approaching the intersection in S110, the process returns to S100.

On the other hand, if the vehicle is in a condition of approaching the intersection in S110, the process proceeds to S120, and the operation of the navigation apparatus 15 is confirmed. That is, whether the navigation apparatus 15 is providing route guidance is determined.

Then, in S130, the process determines whether or not the navigation apparatus 15 is providing the route guidance based on the confirmation in S120.

If the navigation apparatus 15 is determined to be providing route guidance in S130, then, the process proceeds to S140 and determines whether or not an instruction of turning left is provided. That is, if the route guidance of turning left at the approaching intersection is provided.

If the instruction of turning left is determined to be provided in S140, the process proceeds to S170.

On the other hand, if the route guidance is not being provided from the navigation apparatus 15, the process proceeds to S150, and the process confirms a condition of a blinker.

Then, in S160, the process determines whether or not the left blinker is being turned on based on the blinker condition confirmed in S150.

Then, if the left blinker is determined as not being turned on in S160, the process returns to S100.

If the left blinker is determined as being turned on in S160, the process proceeds to S170.

In S170, the process collects information regarding the proximity of the self-vehicle. For example, based on the captured image around the vehicle from the surround monitor sensor 13, the process collects motorcycle information on the left behind the self-vehicle.

Then, in S180, the process determines whether or not the motorcycle is in the approaching condition from behind the self-vehicle on the left based on the information collected in S170. Whether or not the motorcycle is catching up with the vehicle is determined by, for example, analyzing the captured image. More practically, if the size of the motorcycle in the captured image is increasing as time elapses, it is determined that the motorcycle is catching up with the vehicle.

Then, if the motorcycle is determined as not in the approaching condition in S180, the process returns to S100.

If the motorcycle is determined as in the approaching condition in S180, the process proceeds to S190, and the process then sets the positioning direction of the virtual sound source (the direction to be presented for the driver) for generating a warning/notification sound according to the approaching motorcycle. In this case, if the distance to the motorcycle is available, the presentation distance may also be set.

Then, in S200, the process sets control parameters which are necessary for the stereophonic sound generation by the stereophonic generation unit 31 according to the direction of the determined positioning.

Then, in S210, the process selects sound contents. In this case, the sound contents that simulate motorcycle travel sound are selected for outputting the motorcycle-like sound.

Then, in S220, the sound signal processing is performed, by using the sound contents of the motorcycle-like sound and the control parameter to set the positioning direction, and sets output signals to each of the speakers 5 to 9.

Then, in S230, the sound signal is output to each of the speakers 5 to 9 in a corresponding manner for driving those speakers and outputting the generated sound (warning sound) so that the positioning of the virtual sound source (the direction of the virtual sound source and the distance, if necessary) accords with the actual traffic situation.

In the above description, the motorcycle is catching up with the vehicle and is passing the vehicle on the left side from behind the vehicle. However, different situations such as the motorcycle is laterally crossing the vehicle's traveling path perpendicularly at an intersection, or the motorcycle traveling in front on the left side can also be handled in the same manner by the above-described processing.

(4. Advantageous Effects)

The stereophonic apparatus of the present disclosure is capable of notifying the driver of the vehicle by outputting the notification sound from the virtual sound source by using the main-speakers 5, 7 and the sub-speaker 9, based on the information from the sensors that detects traffic conditions around the vehicle. The speakers 5, 7 are positioned at the same distance respectively from the right and the left ears of the driver, and the sub-speaker 9 is positioned in front of the driver on the center plane that rightly divides the driver in terms of left and right.

That is, in the present embodiment, the 3 channel stereophonic system having three speakers 5, 7, 9 is used to improve the positioning effects of the virtual sound source that simulates the sound of the object to be presented for the driver of the vehicle.

(5. Correspondence of the Reference-Numbered Components with Claim Language)

The sensor 1 corresponds to a sensor in appended claims, the main-speakers 5, 7 correspond to a right and a left main-speakers in appended claims, the sub-speaker 9 corresponds to a sub-speaker in appended claims, the control unit 24 corresponds to a control unit in appended claims, the sound image positioning unit 33 corresponds to a positioning unit in appended claims, the sound image enhance unit 35 corresponds to an enhance unit in appended claims, the signal delay unit 37 corresponds to a delay unit in appended claims, the volume adjustment unit 39 corresponds to a volume adjustment unit in appended claims, and the filter unit 41 corresponds to a filter unit in appended claims.

(6. Other Embodiments)

Although the present disclosure has been fully described in connection with preferred embodiment thereof with reference to the accompanying drawings, it is to be noted that various changes and modifications will become apparent to those skilled in the art. Besides, such changes, modifications, and summarized scheme are to be understood as being within the scope of the present disclosure as defined by appended claims.

What is claimed is:

1. A vehicular stereophonic sound apparatus for presenting an object condition of an object based on sensor information that is representative of an in-and-about condition of a vehicle and for outputting notification sound from a virtual sound source toward an occupant of the vehicle, the apparatus comprising:

a right and a left main-speakers installed respectively equidistantly on a right side and a left side relative to a right ear and a left ear of the occupant;

a sub-speaker installed on a right-front position of the occupant, such that the sub-speaker is disposed in front of the occupant on a center plane of the occupant;

a control unit for outputting a control signal for generating virtual sound based on determination of the object condition to be presented for the occupant according to the sensor information;

a positioning unit for positioning a sound image of the object in an actual direction by performing, for a right and a left audio signals respectively directed to the right and the left main-speakers, signal processing that utilizes Head-Related Transfer Function that reflects a position of the object based on the control signal from the control unit;

an enhance unit for enhancing the sound image by performing, for the right and the left audio signals respectively directed to the right and the left main-speakers, signal processing according to the position of the object;

a delay unit for correcting a difference of sound arrival times to the right and the left ears due to a difference of speaker-to-ear distances between the right and left main-speakers and the sub-speakers relative to the right and the left ears based on the control signal from the control unit according to the actual direction of the object;

a filter unit for processing the audio signal directed to the sub-speaker based on the control signal from the control unit according to the actual direction of the object, the filter unit being configured as an FIR filter with a tap number of N; and a volume adjustment unit for adjusting sound volume of the right and the left main-speakers and the sub-speaker independently based on the control signal from the control unit according to the actual direction and a distance of the object, wherein the tap number of N of the FIR filter is determined based on the actual direction of the object, N is set to a lower setting when the actual direction of the object is from a side of the vehicle to a front of the vehicle, than when the actual direction of the object is from a rear of the vehicle.

2. A vehicular stereophonic sound apparatus for presenting an object condition of an object based on sensor information that is representative of an in-and-about condition of a vehicle and for outputting notification sound from a virtual sound source toward an occupant of the vehicle, the apparatus comprising:

a right and a left main-speakers installed respectively equidistantly on a right side and a left side relative to a right ear and a left ear of the occupant;

a sub-speaker installed on a right-front position of the occupant, such that the sub-speaker is disposed in front of the occupant on a center plane of the occupant;

a control unit for outputting a control signal for generating virtual sound based on determination of the object condition to be presented for the occupant according to the sensor information;

a positioning unit for positioning a sound image of the object in an actual direction by performing, for a right and a left audio signals respectively directed to the right and the left main-speakers, signal processing that utilizes Head-Related Transfer Function that reflects a position of the object based on the control signal from the control unit;

an enhance unit for enhancing the sound image by performing, for the right and the left audio signals respectively directed to the right and the left main-speakers, signal processing according to the position of the object;

a delay unit for correcting a difference of sound arrival times to the right and the left ears due to a difference of speaker-to-ear distances between the right and left main-speakers and the sub-speakers relative to the right and the left ears based on the control signal from the control unit according to the actual direction of the object;

a filter unit for processing the audio signal directed to the sub-speaker based on the control signal from the control unit according to the actual direction of the object, the filter unit being configured as an FIR filter with a tap number of N; and a volume adjustment unit for adjusting sound volume of the right and the left main-speakers and the sub-speaker independently based on the control signal from the control unit according to the actual direction and a distance of the object, wherein the tap number of N of the FIR filter is determined based on the actual direction of the object, N is set to a lower setting when the actual direction of the object is from a side of the vehicle to a front of the vehicle, than when the actual direction of the object is from a rear of the vehicle, and the object that is represented by the sound image is actually positioned outside the vehicle.

3. The vehicular stereophonic sound apparatus of claim 2 further comprising:

a sound contents storage unit for storing sound contents that are to be presented for the occupant of the vehicle; and a sound contents selection unit for selecting the sound contents according to the control signal from the control unit.

4. The vehicular stereophonic sound apparatus of claim 3, wherein the sound contents selection unit selects the sound contents so as to simulate a kind of the object to be presented.

* * * * *